United States Patent [19]

Ritter et al.

[11] 4,161,110

[45] Jul. 17, 1979

[54] AUTOMATIC CONTROL DEVICE FOR A BENDING MACHINE

[75] Inventors: Klaus Ritter; Gerhard Ritter; Josef Ritter; Josef Pöhacker, all of Graz; Gert Jahrbacher, Peggau, all of Austria

[73] Assignee: EVG Entwicklungs- und Verwertungs-Gesellschaft mbH., Graz, Austria

[21] Appl. No.: 791,844

[22] Filed: Apr. 28, 1977

[51] Int. Cl.[2] ..... B21D 9/07; B21F 45/00; B21D 7/024; B21D 7/12

[52] U.S. Cl. ..... 72/7; 72/9; 72/11; 72/22; 72/28; 72/307; 72/388; 140/71 R

[58] Field of Search ..... 72/DIG. 4, DIG. 5, DIG. 6, 72/DIG. 16, DIG. 22, 7, 9, 21, 22, 28, 29, 217, 149, 298, 10, 11, 307, 388; 140/71 R

[56] References Cited

U.S. PATENT DOCUMENTS

| | | | |
|---|---|---|---|
| 3,145,756 | 8/1964 | Hill | 72/298 |
| 3,227,195 | 1/1966 | Stegmann | 140/71 R |
| 3,420,279 | 1/1969 | Tuit | 140/71 R |
| 3,426,562 | 2/1969 | Inda | 72/7 |
| 3,563,283 | 2/1971 | Tufektshiev | 140/71 R |
| 3,706,248 | 12/1972 | Erhart | 83/74 |
| 3,732,761 | 5/1973 | Sanders | 83/37 |

*Primary Examiner*—E. M. Combs
*Attorney, Agent, or Firm*—Ernest F. Marmorek

[57] ABSTRACT

The invention relates to an automatic control device for a bending machine for use in the production of loops of bar or wire material for concrete reinforcement. The device includes a preselector for preselecting the type of loop required and determines the sense of direction and amount of bending required in that loop-type. Additionally, a selector is provided for selecting the length of each side of the loop of the type selected by the loop-type preselector.

7 Claims, 1 Drawing Figure

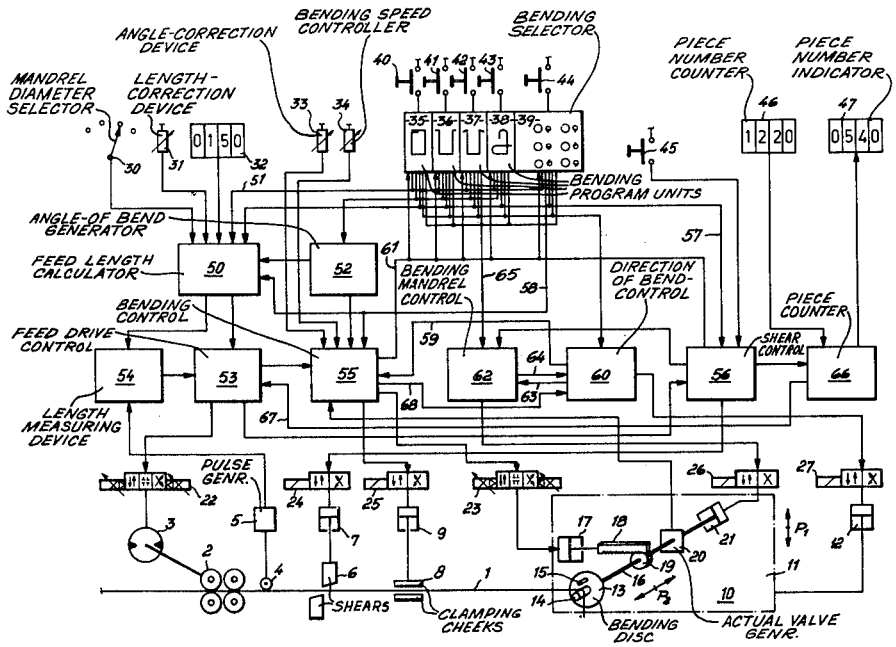

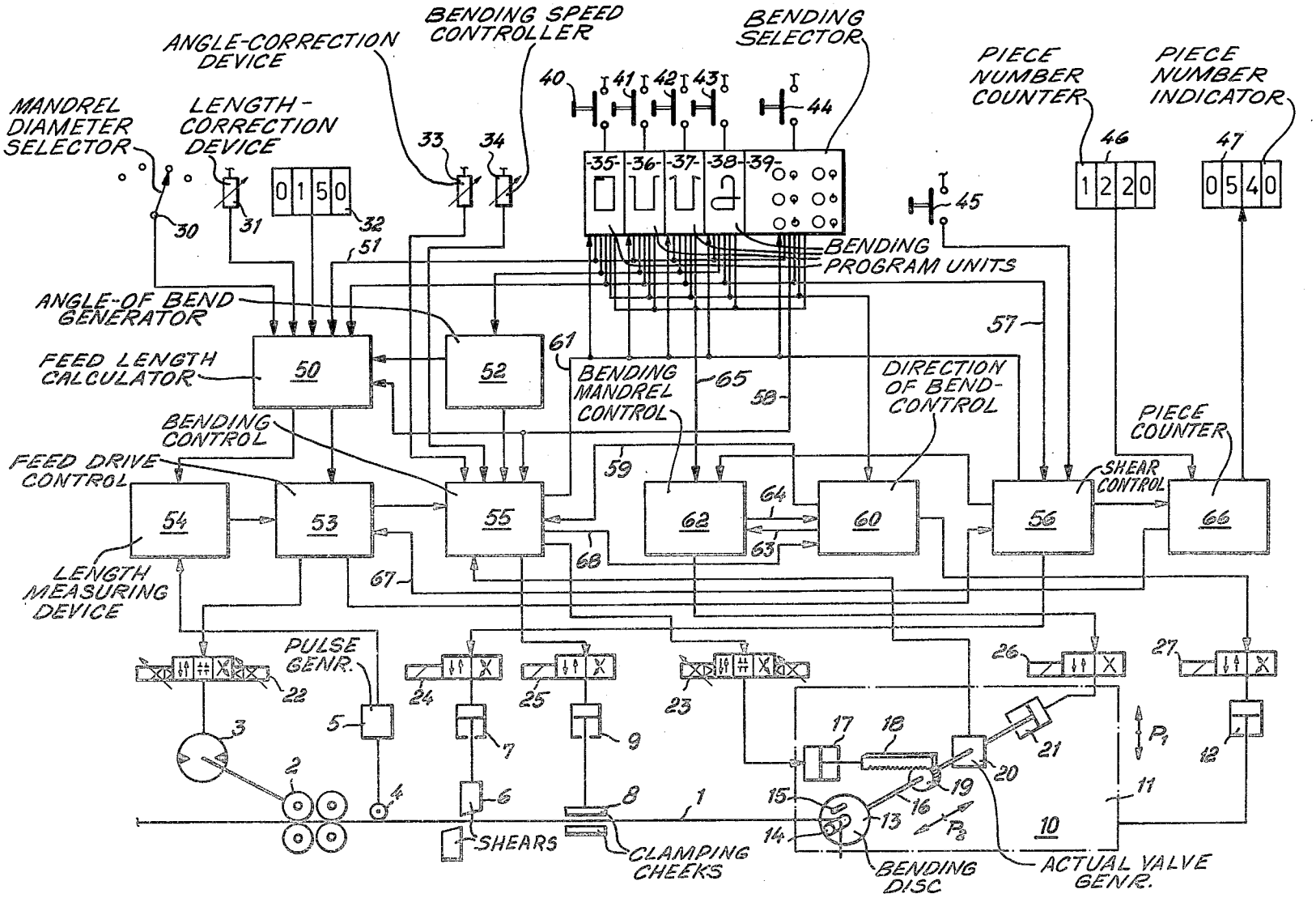
PIECE NUMBER INDICATOR
PIECE NUMBER COUNTER
PIECE COUNTER
SHEAR CONTROL
BENDING PROGRAM UNITS
DIRECTION OF BEND-CONTROL
BENDING SELECTOR
BENDING MANDREL CONTROL
BENDING SPEED CONTROLLER
ANGLE-CORRECTION DEVICE
LENGTH-CORRECTION DEVICE
MANDREL DIAMETER SELECTOR
ANGLE-OF BEND GENERATOR
FEED LENGTH CALCULATOR
BENDING CONTROL
FEED DRIVE CONTROL
LENGTH MEASURING DEVICE
PULSE GENR.
ACTUAL VALVE GENR.
BENDING DISC
CLAMPING CHEEKS
SHEARS

AUTOMATIC CONTROL DEVICE FOR A BENDING MACHINE

The invention refers to an automatic control device for a bending-machine intended for the production of concrete reinforcement loops of bar or wire material, in which all the bending processes necessary to the production of a loop as regards the lengths of the individual sides of the loop, the sense of direction of the individual bending processes and the amount of the angle of bend, as well as the process of severing the finished loop from the bar or wire material can be present.

Bending-machines are known which have sequence control mechanisms which establish a quite definite succession of actions of the individual tools of the bending-machine. For presetting the length of travel by which the bar material to be bent must be advanced between the successive bending processes in order to obtain the desired lengths of the sides between bends, as well as for presetting the amount of each angle of bend, in the known control mechanisms drums are employed which are driven by step-switch mechanisms and along the circumferences of which stops or micro-contacts are arranged, so that they can be moved and fixed. These drums, after each operating cycle of the bending-machine move forward in a partially step-wise manner, so that the next stop or the next micro-contact arrives in the operating position.

Contacts or stops which, in dependence upon the feed stroke covered by the bar material to be bent, or upon the angle of pivot turned through by the bending tool, are moved along a track running parallel with the associated drum, cooperate with the stops or microcontacts on the drums. As soon as associated stops engage, or associated microcontacts coincide, the preset feed stroke of the bar has been covered or the bending tool has turned through the preset angle of pivot, and the next working step provided for in the sequence control is automatically introduced.

These known control mechanisms suffer from several disadvantages. The setting and fixing of the stops or microcontacts along the drums which are often not readily accessible is difficult, and the supposed number of possibilities for the desired setting is limited by the available circumference of the drum. But above all because of the relatively large number of setting processes, rational production of different loops is not possible.

The invention orginates from the fact that most of the concrete reinforcement loops needed in practice can be divided up into relatively small number of types of loops which are characterized by a predetermined sequence of points of bend with a fixed sense of direction and amount of the angle of bend, in which case the loops of the same type differ from one another only in the lengths of the individual sides of the loops between the points of bend, or from one end of the loop to the first point of bend, and from the other end of the loop to the last point of bend. In the case of the simplest closed loop, for example, four points of bend in the same direction each at an angle of bend of 90° follow one another, and in the case of the simplest open loop four points of bend each at an angle of bend of 90° of which the first and fourth are in opposite sense to the second and third. Besides these two, probably most frequently needed, types of loops there are others repeatedly appearing, in which angles of bend in the same and opposite senses at angles of any amount may follow one another.

The invention now is concerned with the problem of creating a control device of the kind specified above, intended for bending-machines, by which more frequently needed types of loop may be produced considerably more rationally than was hitherto possible, and a device according to the invention achieves this by means of a loop-type preselector for selecting at will a required one of a number of fixed basic programs, each being associated a different type of loop, and which determines the sense of direction and amount of the successive angles of bend necessary in that loop-type, and a length-of-side selector for selecting the lengths of successive sides of the loop of the type selected.

By means of such a control device numerous types of loops may be preselected in a simple way, and it is then only necessary to set the lengths of the sides to correspond with what is needed in each case with the selected type of loop. But in order to be able to employ the bending-machine also for the production of types of loops which seldom appear and with which, because of economy, there is no basic program associated, advantageously an additional selector for free choice of the sense of direction and amount of the successive angles of bend is provided for use in combination with the length-of-side selector.

The following description describes with the aid of the accompanying schematic drawing, a control device in accordance with the invention for a bending-machine, the mechanical parts of the bending-machine being indicated in the drawing only by symbols.

The bending-machine 3 to be controlled, draws a wire 1 to be bent from a non-illustrated storage device e.g., a drum of wire, by means of feed rolls 2 which are driven by a reversible hydraulic motor 3. A measuring roll 4 is pressed against the advancing wire 1 and drives an actual-value generator 5 preferably constructed as a pulse generator, and in this way measures the length of the wire 1 already advanced. On the path of feed of the wire 1 there are further arranged shears 6 which can be actuated by an operating cylinder 7, as well as a pair of clamping-cheeks 8, which can be engaged by an operating cylinder 9.

The task of the pair of clamping-cheeks 8 is to clamp the wire 1 firmly to prevent twisting during the bending process, in order to prevent turning of it about its own axis during the bending process. This measure is particularly necessary with ribbed wires which have the tendency under the action of a bending tool to twist in such a way that bending occurs about the axis of their lowest moment of inertia. That would have the result that successive bending processes would occur in different planes; the loops so bent would have warped sides, and would therefore be unusable. The pair of clamping-cheeks 8 arranged just in front of the point of bend eliminates this shortcoming, and twisting of the wire is prevented.

The set of bending tools 10 is mounted on a bearer-plate 11 which can be displaced vertically in the plane of bend in the direction of the double arrow $P_1$, and the displacement of which is effected by means of an operating cylinder 12. The set of bending tools consists of a bending disc 13 with a bending mandrel 14 arranged centrally, and a bending tool 15 arranged ecentrically, the bending disc 13 as a whole being rotatable by means of a shaft 16. In order to be able to bend wires of different diameters at reasonable radii of curvature, a number of interchangeable bending discs 13 with bending mandrels 14 of different diameters are advantageously provided.

For rotating the shaft 16 an operating cylinder 17 is used, which is coupled to the shaft 16, by, for example, a rack 18 and a pinion 19.

An actual-value sensor 20 indicates the angular position of the shaft 16 at any time with respect to a predetermined reference position. An operating cylinder 21 can withdraw the shaft 16 with the bending disc 13 and the bending mandrel 14 and bending pin 15 secured to it, out of the plane of bend in the direction of the double arrow $P_2$ and slide it forwards again into the plane of bend.

The drive of the operating cylinders 7,9,12,17 and 21 is preferably effected hydraulically in the same way.

In order to be able to control all the working processes of the mechanism at option and in the necessary way, electrohydraulic servo-valves 22 and 23 are provided in the pressure-medium feedlines to the hydraulic motor 3 and operating cylinder 17, which regulates the passage of the pressure medium in dependence upon an applied electric voltage. In the pressure-medium feedlines to the operating cylinders 7,9,12, and 21 simple electrohydraulic slidevalves 24,25,27 and 26 respectively are sufficient.

In order to be able to supply the operating and driving elements of the loop-bending machine, described above, with the necessary operating commands, a series of input units is provided.

The main component of the input units is a loop-type preselector device which in the example illustrated contains a number of basic program units 35 to 38; each of which is associated one basic program for one certain type of loop which is illustrated pictorially on the corresponding unit. Into each of these units are programmed the sense of direction and the amounts of the successive angles of bend for the corresponding type of loop. Thus unit 35, for example, is pre-programmed for simple closed loops and unit 36 for simple open loops. Each unit is optionally exchangeable for another unit having another basic program. The corresponding basic program can then be immediately called upon by means of the associated one of a number of preselected switches 40 to 43.

In addition a side length selector device 32 is provided, which is used for the free choice of the lengths of the successive sides of the loop in the case of the type of loop established by the selected basic program.

This selector device includes a plurality of length selector switches which correspond to the number of sides of the most complicated loop that is to be produced automatically by the bending-machine. For the sake of simplicity, however, only one of these selector switches is illustrated.

By preselection of one of the basic program units 35 to 38 by means of one of the switches 40 to 43 and setting of the freely selectable lengths of all the sides for the preselected type of loop by means of the side length selector device 32 the bending-machine is programmed for the desired loop.

Furthermore yet other input units are advantageously provided as described below.

A mandrel diameter selector switch 30 is set to correspond with the diameter of the bending mandrel 14 being used at any time.

By means of a length correction member 31 inaccuracies in length may be compensated, which result perhaps from errors which can be determined empirically such, for example, as by the time of delay between the issue of a switching-off command to the hydraulic motor 3 and the actual coming to rest of this motor.

By means of an angle correction member 33 the inaccuracies in the angles of bend may be compensated which are caused by partial springing back of the wire, depending on the material, after bending.

A setting member 34 for the angular speed of bending allows the speed to be set at which the bending disc 13 is turned. This is advantageous in order to be able always to make use of the bending-machine rationally in dependence of the size of loop at the time. Loops with short sides can be bent much more quickly than loops with long sides because the longer the sides, the more the inertia forces can make themselves felt, which are opposed to an acceleration and which then can lead to undesirable deformations of the sides of the loop against the bending pin 15 in the direction opposite to the desired direction of bend.

In order to be able to bend also loops not belonging to preprogrammed types of loops with the same bending machine, an additional selector device 39 is provided, which can be switched in by a switch 44 and allows, the setting of up to a maximum of six angles of bend of any size in any sense of direction between altogether seven sides of the loop. The selector device 39 is actuated by the switch 44.

Finally one more shear command button 45 is provided, which allows arbitrary severing of the wire at any instant in the production, for example, in the event of trouble with the machine. A piece-number setting counter 46 and a piece-number indicator 47 complete the input part of the equipment.

If by means of the preselector switch 40 the basic program unit 35, for example, is switched on, a feed length calculator 50 is set in action via a lead 51. At the same time a control pulse is issued from the basic program unit 35 to a standard-angle-of-bend generator 52. The standard-angle-of-bend generator 52 can transmit to the operating cylinder 17 bending commands for all the angles of bend appearing in the basic programs, for example, for angles of bend of 45°, 90°, 135° and 180°.

In the present example, i.e., assuming that the basic program unit 35 for closed loops has been pre-selected, only right-angled bends will be operative, and the standard-angle-of-bend generator 52 informs the associated input to the feed length calculator 50 that after the first side a bend by 90° has to follow.

Further information available to the feed length calculator 50 are, from the length-of-side selector device 32, the length of the first side, from the mandrel diameter selector switch 30 the mandrel diameter, from the length correction member 31 a possible length correction, and as a fixed input value, the distance of the shear 6 from the bending mandrel 14.

When instead of a loop of one preprogrammed type of loop another loop is to be produced, the additional selector device 39 is switched on by the switch 44, and is likewise connected via a lead 58 to the feed length calculator 50.

In the feed length calculator 50 the feed travel is now determined, which is necessary in order to obtain the first side of the loop of the desired length. In the case of the first side of the loop the distance from the shear 6 to the bending mandrel 14 has to be added for the time being to the length of the side for this purpose. Then a length correction which may be set on the length correction member 31 has to be added algebraically, and finally according to the input on the part of the mandrel diameter selector switch 30 an adjustment value has to be determined, which results from the fact that the loops in the loop drawings are shown as polygonal figures with the lengths of the sides measured from corner to corner, but in fact they exhibit instead of sharp corners relatively smooth transitions occur, which correspond to the diameter of the bending mandrel.

The length so determined is fed as a desired value into the length measuring device 54 and at the same time via the corresponding input a starting pulse is transmitted to a feed drive control 53. The feed drive control 53 now applies a control voltage to the electrohydraulic servo-valve 22, so that the hydraulic motor 3 is set in action.

The wire 1 is now fed forward, so that the measuring roll 4 is set in rotation, and the actual value generator 5 generates corresponding pulses. The actual value of the path covered by the wire is passed back to the length measuring device 54 and there compared with the desired value. As soon as coincidence between actual and desired values is reached, the length measuring device 54 transmits a pulse to the feed drive control 53 which in turn now brings the electrohydraulic servo-valve 22 into the blocking position, and hence stops the hydraulic motor 3. The feed movement covered is at the same time relayed from the feed drive control 53 on the one hand, to the bending drive control 55, and on the other hand to the shear control 56.

Since the shear control 56 can only start a cut when it at the same time receives a command to that effect also via the lead 57 from that one of the basic program units 35 to 38 which is switched on at the time, or from the additional selector device 39, in the example chosen, from the unit 35, it is temporarily not actuated.

The bending drive control 55, apart from the input from the feed drive control 53, also includes inputs used for feeding in and correcting the instantaneous angle of bend to be executed from the standard-angle-of-bend generator 52, via the lead 58 from the additional selector device 39, and from the angle correction member 33, as well as including an input from the setting member 34 for the angular speed of bending.

Yet further information may be fed to the bending drive control 55 via a lead 59 from a direction-of-bend control 60.

From the information fed to it via the different inputs just mentioned the summation angle is formed in the bending angle drive control 55 and a corresponding control voltage is applied to the electrohydraulic servo-valve 23, so that the piston in the operating cylinder 17 is acted upon in the desired sense by the pressure medium.

At the same time the electrohydraulic slidevalve 25 is switched in such a way that the piston in the operating cylinder 9 moves the movable of the two clamping cheeks 8 towards the fixed cheek, and hence clamps the wire 1 to prevent it from twisting.

The operating cylinder 17 via the rack 18 and the pinion 19 sets the shaft 16 in motion, and with it the bending disc 13. The magnitude of this motion is repeated back by the actual value generator 20 to the bending drive control 55 and continuously compared therein with the desired value of the angle. As soon as the actual and desired values agree the piston in the operating cylinder 17 is brought to a stop via the electrohydraulic servo-valve 23 and at the same time the clamping-cheeks 8 are lifted clear. Next, a control voltage is applied to the electrohydraulic servo-valve 23 which brings about a return motion of the bending disc into the original position from which it began the bending motion.

After completion of the bending motion, that is, when the bending disc 13 is again in its original position, a control pulse passes via a lead 61 to all the basic program units 35 to 38, and to the additional selector device 39, so that the unit which is switched on at the time—in the example chosen, the unit 35—is caused to introduce the next working step.

If, in the next working step, a bending process follows having the same sense of direction as that just executed, the cycle just described is repeated. If the next working step demands a change in the direction of bend, then a pulse passes to the direction-of-bend control 60 from one of the units 35 to 39 which is switched in at the time.

The direction-of-bend control 60 transmits a pulse via the lead 63 to the bending mandrel control 62, whereupon the latter switches the electrohydraulic slidevalve 26 in such a way that the operating cylinder 21 draws back the shaft 16, and with it shifts the bending disc 13 out of the plane of bend.

As soon as the bending disc 13 has been removed from the plane of bend, a repeating pulse is issued via the lead 64 to the direction-of-bend control 60, which now at the same time via the electrohydraulic slide valve 27 actuates the operating cylinder 12, which displaces the bearer-plate 11 in a sense such that the bending mandrel 14 changes its position in relation to the feed path of the wire 1.

At the same time a pulse is transmitted over the lead 59 to the bending drive control 55, to cause the bending drive control 55 to apply a voltage to the electrohydraulic servo-valve 23, such that the operating cylinder 17 brings about a half-turn of the bending disc 13. The bending mandrel 14 and the bending tool 15 now have their positions in relation to the feed path of the wire 1 interchanged. The completed change of position is repeated back over the lead 68 to the direction-of-bend control 60, which now in turn causes the bending mandrel control 62 to push the bending disc 13 forwards again into the bending plane via the lead 63.

As soon as the bending disc 13 has been returned to the plane of bend, a repeating pulse is issued by the bending mandrel control 62 via units 64-60-59-55-61, to the units 35 to 39, in the example chosen in particular to the switched-on basic program unit 35, which brings about the next operating step.

In the case of loops of such shape that parts already bent must, upon feeding the wire forward be led past and over the bending mandrel 14 (cf., say, the shape of the loop shown in the basic program unit 38), impeding of the feed by the bending mandrel 14 is avoided by a control pulse being generated via the lead 65 from the switched-on unit of the units 35 to 39, to the bending mandrel control 62, by which procedure a withdrawal of the bending disc for a limited time during feeding forward of the wire, and a subsequent run out again of the bending disc 13 into the operating position are achieved.

As soon as the last bending process is completed a command issued via the lead 57 by the unit of the units 35 to 39 which is switched on, which command also acts on the shear control 56 as a shear command, results in the feed length calculator causing a withdrawal of the completed and bent loop by the pre set distance between the shears 6 and the bending mandrel 14, in which case the bending mandrel is naturally also retracted. Since in this case the shear control 56 obtains both from the feed drive control 53 and from the unit of the units 35 to 39 which has been switched on, a shear command, a voltage is applied to the electrohydraulic slidevalve 24 such that the operating cylinder 7 actuates the shears 6 in a cutting direction.

A report pulse is issued by the shear control 56 to the piece counter 66 and, another pulse is fed to the bending mandrel control 62, so that it causes the bending mandrel 14 to be pushed forward again into the operating position, and finally via the lead 61 there is fed a pulse to all the units 35 to 39 so that these are caused to prepare a new bending cycle.

But as soon as coincidence is attained between the piece number setting counter 46 and the piece number indicator 47, that is, when the required total number of loops have been bent a switch-off command is issued via the lead 67 to the feed drive control 53 to cause the equipment to a stop.

The embodiment described above allows of various modifications within the scope of the invention. Thus in particular the basic program units provided for the different types of loop and which can be switched in at will may be substituted by one basic program apparatus common for all types of loops, which can be switched over by punchcards or the like.

We claim:

1. An automatic bending machine for producing different types of loops in a trial-run free manner from a continuous wire comprising, in combination:

a feeding station including means for guiding said rod along a feeding path, and wire shearing means;

a bending unit including a mandrel and a bending tool angularly displaceable about an axis of rotation in opposite directions in said feeding path, displaceable in a direction perpendicular to said axis of rotation, and axially displaceable from said feeding path;

a power drive circuit including a plurality of reversible power drive units and switching units for actuating said feeding station and said bending unit; and a programmable control device including a plurality of program units, each having a basic fixed program determining the direction of bending and the magnitude of angles of successive bends for different types of the loop to be produced, a loop-type preselector for activating a selected one of said program units, a length-of-sides selector programmable for determining the length of successive sides of the selected loop, data processing means for comparing actual values measured on the loop in process with programmed values and for producing a succession of control signals applied to said power drive circuit to control the direction of travel and shearing of said wire by said shearing means in said feeding station, and the angular and axial displacements and change of direction of rotation of said mandrel and bending tool in said bending unit in accordance with the selected program and in response to the measured actual value.

2. A bending machine as claimed in claim 1, wherein said bending unit is displaceable in a vertical direction relative to said path of feeding.

3. A control device according to claim 1, further including an additional loop-type preselector for selecting the sense of direction and amount of successive angles of bend, for use in combination with the length-of-sides selector.

4. A control device according to claim 1, further including a selector switch for taking into account the diameter of said mandrel, and a feed length calculator having an input from at least one of the loop-type preselectors, an input from said length-of-sides selector, and an input from said selector switch, said feed length calculator calculating the required length of said rod required for the loop.

5. A control device according to claim 4, further comprising a continuously adjustable length correction member connected to said feed length calculator.

6. A control device according to claim 1, further including bending drive control means, controllable by one of said loop-type preselectors, said bending drive control means having an additional control input, and an angle correction element connected to said additional control input of said bending drive control means and determining the spring back of said rod at the time of bending.

7. A control device according to claim 6, wherein said bending drive control means further includes angular speed of bending control means.

* * * * *